US009120108B2

(12) United States Patent
Höfte

(10) Patent No.: US 9,120,108 B2
(45) Date of Patent: Sep. 1, 2015

(54) FOAM GENERATING DISPENSER

(75) Inventor: Paulus Antonius Augustinus Höfte, Astene (BE)

(73) Assignee: The Procter & Gamble Company, Cincinnati, OH (US)

( * ) Notice: Subject to any disclaimer, the term of this patent is extended or adjusted under 35 U.S.C. 154(b) by 66 days.

(21) Appl. No.: 13/540,640

(22) Filed: Jul. 3, 2012

(65) Prior Publication Data

US 2014/0008394 A1 Jan. 9, 2014

(51) Int. Cl.

| | |
|---|---|
| ***B67D 7/76*** | (2010.01) |
| ***B05B 7/00*** | (2006.01) |
| ***B05B 11/04*** | (2006.01) |
| *B05B 11/00* | (2006.01) |
| *B05B 7/04* | (2006.01) |

(52) U.S. Cl.

CPC ..... *B05B 7/0037* (2013.01); *B05B 11/04* (2013.01); *B05B 11/046* (2013.01); *B05B 7/0433* (2013.01); *B05B 11/0027* (2013.01); *B05B 11/0059* (2013.01)

(58) Field of Classification Search

USPC ..... 222/190, 209, 214, 92–97, 130–131, 222/635, 501, 519–525, 544–563, 211

See application file for complete search history.

(56) References Cited

U.S. PATENT DOCUMENTS

| | | | | | |
|---|---|---|---|---|---|
| 3,471,064 | A | * | 10/1969 | Micallef | 222/211 |
| 3,622,049 | A | * | 11/1971 | Thompson | 222/190 |
| 3,709,347 | A | | 1/1973 | Verbeke | |
| 3,937,364 | A | * | 2/1976 | Wright | 222/190 |
| 4,013,228 | A | * | 3/1977 | Schneider | 239/401 |
| 4,027,789 | A | * | 6/1977 | Dickey | 222/190 |
| 4,429,834 | A | | 2/1984 | Ito | |
| 4,509,661 | A | * | 4/1985 | Sugizaki et al. | 222/190 |
| 4,615,467 | A | * | 10/1986 | Grogan et al. | 222/190 |
| 4,846,376 | A | * | 7/1989 | Palmer | 222/190 |
| 4,925,106 | A | * | 5/1990 | Maas et al. | 239/333 |
| 5,033,654 | A | * | 7/1991 | Bennett | 222/190 |
| 5,037,006 | A | | 8/1991 | Kock | |
| 5,048,750 | A | * | 9/1991 | Tobler | 222/190 |
| 5,156,307 | A | * | 10/1992 | Callahan et al. | 222/190 |
| 5,158,233 | A | * | 10/1992 | Foster et al. | 239/333 |
| 5,183,186 | A | * | 2/1993 | Delaney, Jr. | 222/211 |
| 5,219,102 | A | * | 6/1993 | Wright | 222/190 |
| 5,273,191 | A | | 12/1993 | Meshberg | |
| 5,275,338 | A | * | 1/1994 | Tobler | 239/327 |
| 5,318,205 | A | * | 6/1994 | Delaney, Jr. | 222/211 |
| 5,373,991 | A | * | 12/1994 | Nelson | 239/333 |
| 5,467,898 | A | * | 11/1995 | Hori | 222/190 |
| 6,267,304 | B1 | * | 7/2001 | Schultz | 239/327 |

(Continued)

FOREIGN PATENT DOCUMENTS

| | | |
|---|---|---|
| JP | 08026315 A2 | 1/1996 |
| JP | 10128189 | 5/1998 |
| WO | WO 2005/056415 A1 | 6/2005 |

OTHER PUBLICATIONS

International search report dated Sep. 15, 2013, 10 pages.

*Primary Examiner* — Kevin P Shaver
*Assistant Examiner* — Michael J Melaragno
(74) *Attorney, Agent, or Firm* — David K Mattheis

(57) ABSTRACT

A device for dispensing liquids in the form of foam. The device including a container and a foam engine having a gas inlet, a liquid inlet and a foam discharge. The device also including a vent comprising a switchable valve between the environment and the interior of the device container.

20 Claims, 3 Drawing Sheets

(56) References Cited

U.S. PATENT DOCUMENTS

| | | | | |
|---|---|---|---|---|
| 6,398,133 | B1 * | 6/2002 | Schultz | 239/327 |
| 6,402,054 | B1 * | 6/2002 | Prueter et al. | 239/327 |
| 6,505,986 | B1 * | 1/2003 | Oder | 401/183 |
| 6,536,685 | B2 * | 3/2003 | Bennett | 239/343 |
| 6,557,783 | B1 * | 5/2003 | Foster et al. | 239/343 |
| 6,604,693 | B2 | 8/2003 | Santagiuliana | |
| 6,758,374 | B2 * | 7/2004 | Albisetti | 222/209 |
| 7,159,798 | B2 * | 1/2007 | Carta | 239/424 |
| 8,408,426 | B2 * | 4/2013 | Bakhos | 222/209 |
| 8,430,107 | B2 * | 4/2013 | Huang | 132/113 |
| 2002/0130198 | A1 | 9/2002 | Bennett | |
| 2004/0229763 | A1 | 11/2004 | Hutton et al. | |
| 2004/0251272 | A1 * | 12/2004 | Hunter | 222/95 |
| 2010/0133294 | A1 | 6/2010 | Chan et al. | |
| 2010/0133301 | A1 | 6/2010 | Chan et al. | |
| 2013/0068794 | A1 * | 3/2013 | Kodama et al. | 222/190 |
| 2013/0214009 | A1 * | 8/2013 | Bakhos | 222/209 |
| 2014/0008394 | A1 * | 1/2014 | Hofte | 222/190 |
| 2014/0209639 | A1 * | 7/2014 | Sasaki et al. | 222/190 |

* cited by examiner

FOAM GENERATING DISPENSER

FIELD OF THE INVENTION

The device herein relates to foam-generating dispensers. The device relates particularly to foam generating dispensers for consumer products.

BACKGROUND OF THE INVENTION

Foaming dispensers are becoming popular for various consumer product applications. As examples, foaming personal care dishwashing, hard surface cleaning, skincare, shaving, haircare and haircolorant compositions are increasingly prevalent in commercial markets. During cleaning, especially dishwashing, and more especially manual dishwashing, voluminous foam is viewed as a direct indicator of the proper dishwashing composition concentration and/or water dilution factor. In a consumer cleaning product, consumers also view suds as an indication of how well the composition is cleaning and/or removing oil and soils. It is a natural habit for a person washing dishes to add more dishwashing composition when the foam level or volume decreases, as the cleaning performance is viewed as directly correlated to the foam level; as the foam level decreases, the cleaning performance is perceived as decreasing.

Additionally, it is common for consumers to develop the habit of inverting, partially or completely, the bottle containing a foaming composition as they dispense the product onto any surface, a cleaning implement (i.e. sponge), into the wash basin, directly on their skin or on their hair. Contrary to this habit, many foaming dispensers are limited to proper operation only when positioned up-right; such is the case for many pump-type dispensers. In cases where dispensers are designed for inverted dispensing, it has been found that providing a uniform foaming profile over a usage cycle has not been sufficiently achieved. Specifically, it is often the case that the foam weight to foam volume ratio decreases as the level of product in the container is depleted.

Containers and specifically dispensing containers for forming foam are well known in the trigger-sprayer and aerosol arts, the toilet bowl cleaning art, the shaving foam art, and the hand and body washing arts. Such dispensers typically contain a gas injection mechanism such as an air-injection piston, a propellant gas, and a foam-generating aperture. A pressurized gas is turbulently combined with a liquid as it exits the container By employing this turbulent mixing and/or foam-generating aperture, a foam is created. In addition, while foam-generating dispensers are also known for cleaning purposes such as car washing, and industrial cleaning, such foam-generating dispensers typically yield a foam degraded in texture and/or performance due to a tortuous foam delivery path.

Accordingly, the need exists for a foam dispenser which provides a uniform foam which is not degraded by a tortuous foam delivery path.

BRIEF DESCRIPTION OF THE DRAWINGS

While the specification concludes with claims particularly pointing out and distinctly claiming the invention, it is believed that the invention will be better understood from the following description of the accompanying figures in which like reference numerals identify like elements, and wherein:

FIG. 3 illustrates a cross-sectional schematic view of a embodiment of the invention.

Figure 1:
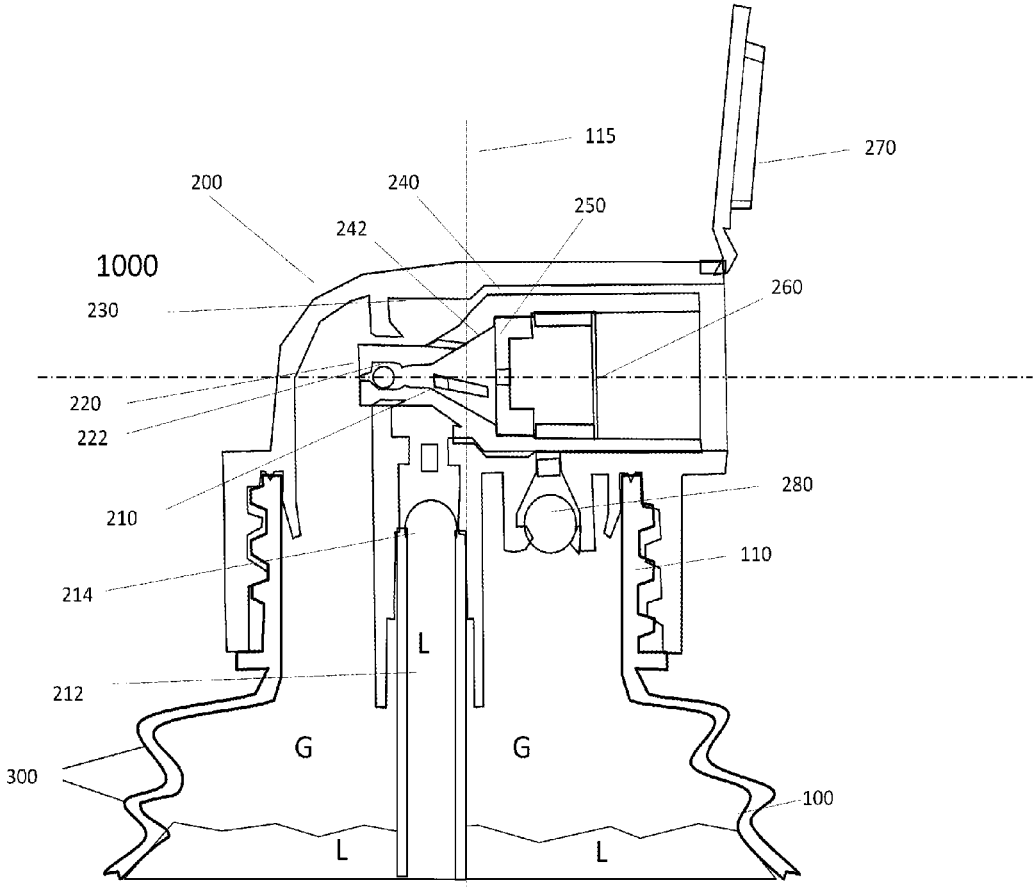
FIG. 1 illustrates a cross-sectional schematic view of one embodiment of the invention.

The figures herein are not necessarily drawn to scale.

DETAILED DESCRIPTION OF THE INVENTION

All percentages, ratios and proportions herein are by weight of the final dishwashing composition, unless otherwise specified. All temperatures are in degrees Celsius (° C.) unless otherwise specified.

As used herein, the term "comprising" means that other steps, ingredients, elements, etc. which do not affect the end result can be added. This term encompasses the terms "consisting of" and "consisting essentially of".

As used herein, the terms "foam" and "suds" are used interchangeably and indicate discrete bubbles of gas bounded by and suspended in a liquid phase.

As used herein, the term "usage cycle" means the period from the liquid composition first being dispensed from a container until the volume of liquid is essentially depleted from the container. The term further means that the container is filled or nearly filled to capacity with a liquid composition prior to the liquid first being dispensed. A "filled" or "empty" container can generally be appreciated by a user/consumer.

In one embodiment, the device comprises the container and a foam engine operably connected to the container. The container useful herein has a hollow body for holding a foaming composition, and is typically a bottle or canister formed of plastic, preferably a polymer or resin such as polyethylene, polypropylene, polyethylene terephthalate, polycarbonate, polystyrene, ethyl vinyl alcohol, polyvinyl alcohol, thermoplastic elastomer, and combinations thereof, although other materials known in the art may also be used. The container may be formed from a virgin resin, a reground or recycled resin, petroleum derived resins, bio-derived resins from plant materials, and combinations of such resins. The containers may comprise fillers and additives in addition to the base resin material. Exemplary fillers and additives include colorants, cross-linking polymers, inorganic and organic fillers such as calcium carbonate, opacifiers, and processing aids as these elements are known in the art. Such containers may typically hold from about 30 mL to about 3 L of liquid. In one embodiment, the containers may hold from about 150 mL to about 1.5 L of liquid. In one embodiment, the containers may hold from about 200 mL to about 1 L of liquid, and are well known for holding liquid consumer products. Such containers are widely available from many packaging suppliers.

The container comprises an interior which is adapted to concurrently contain a liquid reservoir and a gas reservoir. In one embodiment, the liquid and gas may occupy portions of a single interior volume with the gas occupying a head space of the volume. In this embodiment, the volume of the head space increases as the liquid is dispensed from the device as a foam.

In one embodiment, the liquid and gas reservoirs may be separated by a membrane. In this embodiment the liquid may be provided in a pouch, or bag, or delaminating bottle structure which collapses as the liquid is dispensed. The pouch may be distinctly separate from the external walls of the container or the container may comprise a dual external wall which selectively delaminates as the liquid is dispensed. The de-lamination of a portion of the internal wall from the external portion of the wall results in a collapsing pouch containing the liquid and separating the liquid from the gas.

In one embodiment, the device may comprise the container, the foam engine and the product pouch. When assembled the foam engine is placed in fluid communication with the liquid product. In this embodiment, refill pouches may be offered as an alternative to replacing the entire device.

The container comprises a finish adapted to receive the foam engine, the finish has an axis of orientation substantially aligned with the centerline of the finish. The centerline is an imaginary line disposed perpendicular to a plane defined by the outlet of the container finish and passing though the geometric center of the finish. The finish may comprise a threaded connected adapted to mate with threads of the foam engine. The finish may be snap-fit to the foam engine. The finish may comprise an integral part of the container or may comprise a separate part which is attached to the container. The combination of the container and the foam engine via the mating of the foam engine with the container finish may be substantially air-tight to contain a pressure build-up within the interior of the container necessary for the dispensing of the liquid as a foam.

The walls of the container may be generally pliable and resilient enabling the container to be squeezed reducing the container volume and increasing the pressure in the container. In one embodiment, only a portion of the container wall may be resilient enough to be deformed to produce the pressure increase. In one embodiment, a pump may be included as part of the container. In this embodiment, the pump may include a simple accordion bellows and a one-way check valve disposed between the interior and the exterior of the container, or other air pump mechanisms as are known. Activation of the bellows will reduce the volume of the container interior and increase the pressure. Repeated application of the bellows will increase the amount of air within the container and increase the pressure within the container. Other techniques, in lieu of a propellant and/or pressurized container, for providing a force to a dispenser include use of a stretched elastic component such as described in US20100133294 and US20100133301.

The respective components of the foam engine may comprise polymeric resins as described above, metal, or glass. Exemplary methods for manufacturing the components of the foam engine include, without being limiting, injection molding, casting, and machining the components.

The foam engine has an axis of foam discharge. The orientation of the axis of foam discharge is substantially different from the orientation of the axis of the container finish. Substantially different means the two axes either form an oblique angle or are perpendicular to each other. The foam engine comprises a mixing chamber. While the foam engine is attached to the container, the mixing chamber comprises a first inlet in fluid communication with the liquid reservoir, a second inlet in fluid communication with the gas reservoir, and an outlet downstream from the mixing chamber along the axis of foam discharge. The mixing chamber may have a converging or diverging cross section, such as a conical cross section as taken along the axis of foam discharge. The conical cross section may either diverge or converge along the axis toward the outlet of the mixing chamber. Other cross sections may be elliptical, polygonal, half-moon or crescent shaped et al. The cross-section may vary in shape along the flow path as the total area increase or decreases, or portions of the chamber may not diverge or converge along parts of the flow path length. The first inlet may be operably connected with the fluid reservoir via a dip tube. The dip tube may comprise a hollow tube disposed between the first inlet and container interior and extending from the first inlet to a point substantially at the portion of the interior furthest from the inlet or near the bottom of the interior when the device is oriented with the foam engine on top of the container. A check valve may be disposed between the first inlet and the dip tube such that liquid may flow through the valve into the mixing chamber but be prevented from flowing back from the mixing chamber into the dip tube or the reservoir. A second check valve may be disposed in the fluid pathway of the second inlet associated with the gas reservoir, again enabling flow from the reservoir into the mixing chamber but preventing flow from the mixing chamber back into the reservoir.

The foam engine further comprises a diffuser disposed downstream along the axis of foam discharge from the outlet of the mixing chamber. The diffuser may comprise a single outlet orifice or a plurality of outlet orifices. In one embodiment, the diffuser comprises a single mesh having a plurality of orifices disposed in a substantially uniform pattern with respect to the axis of foam discharge. In an alternative embodiment, the diffuser comprises a plurality of mesh elements disposed in sequence along and generally perpendicular to, the axis of foam discharge. In this embodiment, the pore size of each subsequent mesh along the axis is smaller than the orifice size of the preceding mesh.

In one embodiment, the foam engine comprises an engine body comprising a cylindrical barrel, a valve switchable between open and closed states, an engine insert disposed within the barrel; and a diffuser disposed within the engine insert. In this embodiment, the barrel comprises a first inlet in fluid communication with the liquid reservoir and, a second inlet in fluid communication with the gas reservoir. The insert comprises a mixing chamber having a first mixing chamber inlet in fluid communication with the first barrel inlet and a second mixing chamber inlet in fluid communication with the second barrel inlet. The fluid communication may due to substantial alignment between the respective inlets or may exist without substantial alignment.

In one embodiment, the insert may be rotatable about the axis of foam discharge. Rotating the insert may result in at least one or both of the mixing chamber inlets ceasing to be in fluid communication with the corresponding engine body inlet. This closes the corresponding fluid pathway (both liquid and gas inlet) to the mixing chamber preventing mixing and foam formation. In one embodiment, rotating the insert may also close the venting valve.

In one embodiment, the insert may be movable along the axis of foam formation such that in a first position, the inlets to the mixing chamber are clear and gas and liquid may flow freely into the mixing chamber from the container. In a second position, associated with pushing or pulling the insert, at least one of the fluid pathways is blocked preventing foam formation. The respective positions of the insert in this embodiment may also alter the operative state of the venting valve such that it is operable in the first position and inoperable in the second position.

The device further comprises a valve switchable between open and closed states disposed between the interior of the container and the exterior of the container. The valve serves as a vent between the interior and exterior of the container. As the pressure within the container begins to increase, the valve closes enabling a further increase in the container pressure. As the pressure in the container drops, the valve opens enabling the pressure to drop faster by allowing air to flow from the exterior into the container. The valve may comprise a ball-check valve, a flapper or flap valve, a duck bill valve, a disc valve, an umbrella valve or other one way valves as are known in the art.

In one embodiment, the device further comprises a cap disposed at the outlet of the foam engine. The cap may be moved from a first position wherein the outlet is substantially occluded such that foam may not flow from the engine, to a second position wherein the outlet is substantially open and foam may flow unimpeded from the engine outlet. The cap may comprise an integral hinged portion of the device or may comprise a removable cap intended to be separated from the device when the device is in use.

In general, the operation of the device proceeds as follows: the container holds a foamable liquid and a volume of gas, such as air, in its headspace; the container is pressurized, either using a pump, gas propellant or simply be squeezing a resilient portion of the container wall; as the pressure increases, the venting valve closes; the increasing pressure forces liquid and gas into the mixing chamber, this gas-liquid mixture is then compressed through a narrow diffuser hole after which the gas can expand in the mixture resulting in the dispensing of foam from the outlet.

The device may be utilized to generate foam in any orientation. When the device is inverted, the respective roles of the first and second inlets are reversing due to the altering of the position of the liquid and gas within the container. In this orientation, liquid flows through the second inlet and gas (air) flows through the first inlet into the mixing chamber. It should also be noted that the device can be used in a wide range of tilting angles as long as the gas inlet is not blocked by the liquid and depending on the fill level of the container. It is the intent of the invention to achieve the widest possible range of tilting angles in use. By placing the dip tube entry at the lowest point during the tilting will further increase this operating window.

The liquid may comprise any foamable liquid. Exemplary liquids include: surface treatment (including without being limiting to cleaning and/or polishing) products for fabrics, hard surface, skin and/or hair, teeth. Examples of foamable liquids may include at least one of: liquids, solutions including aqueous solutions, liquid suspensions of solids and/or gaseous components, emulsions and gels.

The foam engine may be used with a variety of products comprising a foamable liquid in industry and/or the marketplace, including "consumer care products." Such consumer care products offered by the consumer care industry include, for example and without limitation, soft surface cleaners, hard surface cleaners, glass cleaners, ceramic tile cleaners, toilet bowl cleaners, wood cleaners, multi-surface cleaners, surface disinfectants, dishwashing compositions, laundry detergents and stain treatments, fabric conditioners, fabric dyes, surface protectants, surface disinfectants, motor vehicle surface treatments, and other like consumer products. Consumer care products may also be for household or home care use as well as for professional, commercial and/or industrial use. The consumer product industry may also produce "personal care products" comprising foamable liquids including, for example and without limitation, hair treatment products including mousse, hair spray, styling gels, shampoo, hair conditioner (leave-in or rinse-out), cream rinse, hair dye, hair coloring product, hair shine product, hair serum, hair anti-frizz product, hair split-end repair products, permanent waving solution, antidandruff formulation; bath gels, shower gels, body washes, facial cleaners, skin care products including sunscreen and sun block lotions, skin conditioner, moisturizers, perfumed and non-perfumed underarm and body antiperspirant compositions and deodorants, soaps, body scrubs, exfoliants, astringent, scrubbing lotions, depilatories, shaving products, preshaving products, after shaving products, toothpaste or dentifrice. Other applications of the foam engine can apply to other foamable liquids in other categories of products such as: indoor and/or outdoor insecticide and herbicide products applied indoors or outdoors; the medicinal industry having product forms including, for example and without limitation, medications, medicaments and treatments which include, ointments, creams, lotions, and the like; and, the food industry for use in culinary foamed foods, such as foamed drinks as well as components such as food toppings like whipped cream, coffee creamers, mousse, cheese product, baking products, and meringue.

EXAMPLES

As shown in FIG. 1: the device 1000, comprises a container 100. The container comprises a finish 110 and contains liquid L and gas G. The finish has an axis or orientation 115. Foam engine 200 is attached to finish 110 and comprises a first inlet 210, a dip tube 212, a check valve 214, a second inlet 220, a gas check valve 222, a barrel 230, an insert 240, a diffuser 250, a mesh 260, a hinged cap 270 and a valve 280. The insert comprises a mixing chamber 242. Pressurizing element 300 comprises a portion of the wall of the container 100.

Figure 2:
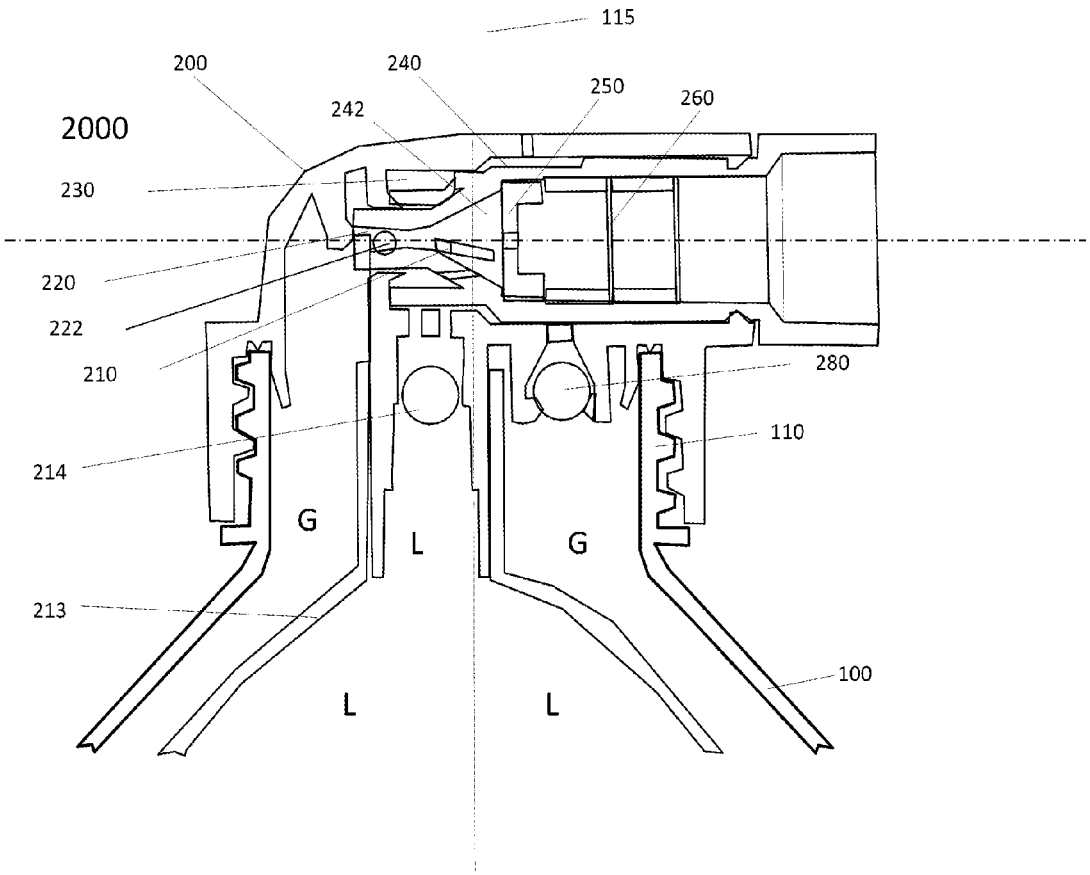

As shown in FIG. 2: the device 2000, comprises a container 100. The container comprises a finish 110 and contains liquid L and gas G. The finish has an axis or orientation 115. Foam engine 200 is attached to finish 100 and comprises a first inlet 210, a pouch 213, a check valve 214, a second inlet 220, a gas check valve 222, a barrel 230, an insert 240, a diffuser 250, a mesh 260, and a valve 280. The insert comprises a mixing chamber 242 and may be rotated about the axis of foam discharge.

Figure 3:
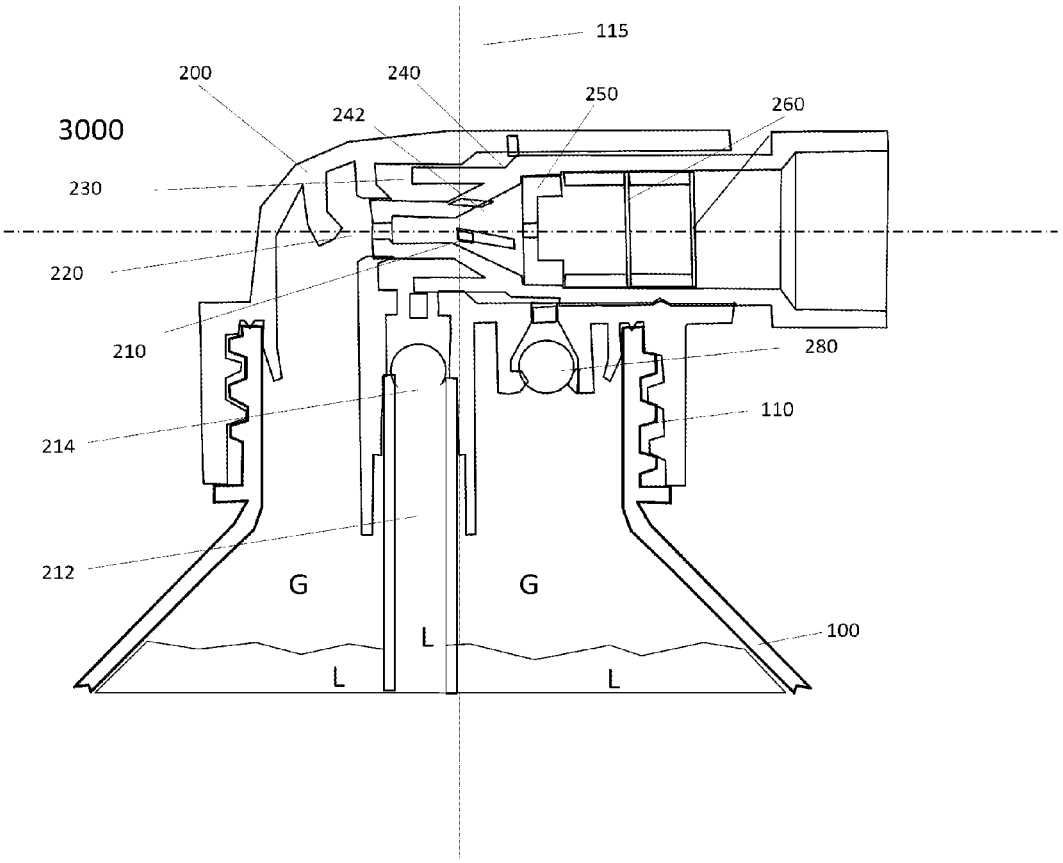
FIG. 3 illustrates a cross-sectional schematic view of a second embodiment of the invention.

As shown in FIG. 3: the device 3000, comprises a container 100. The container comprises a finish 110 and contains liquid L and gas G. The finish has an axis or orientation 115. Foam engine 200 is attached to finish 100 and comprises a first inlet 210, a dip tube 212, a check valve 214, a second inlet 220, a barrel 230, an insert 240, a diffuser 250, a mesh 260 and a valve 280. The insert comprises a mixing chamber 242 and may be moved laterally along the axis of foam discharge.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A device for dispensing liquids in the form of foam, the device comprising a container and a foam engine operably connected to the container, the container comprising:

an interior, the interior adapted to concurrently comprise a liquid reservoir and a gas reservoir;

a finish adapted to receive the foam engine, the finish having an axis of orientation substantially aligned with a centerline of the finish;

the foam engine having an axis of foam discharge, the orientation of the axis of foam discharge being substantially different from the orientation of the axis of the container finish, the foam engine comprising:

a mixing chamber, the mixing chamber comprising: a first inlet in fluid communication with the liquid reservoir, a second inlet in fluid communication with the gas reservoir, and an outlet downstream from the mixing chamber along the axis of foam discharge;

a check valve disposed along the second inlet, the check valve configured to allow fluid flow from the reservoir into the mixing chamber and to prevent the flow of fluid from the mixing chamber into the reservoir;

a diffuser disposed downstream along the axis of foam discharge from the outlet of the mixing chamber;

a vent comprising a valve switchable between open and closed states disposed between the interior of the container and the exterior of the container.

2. The device according to claim 1 wherein the foaming engine further comprises a mesh element disposed downstream from the diffuser along the axis of foam discharge.

3. The device according to claim 1 wherein the mixing chamber comprises a conical cross section.

4. The device according to claim 1 wherein the device comprises a hinged cap at an outlet of the foam engine.

5. The device according to claim 1 wherein the device comprises a container pressurizing element.

6. The device according to claim 1 wherein the diffuser comprises a diverging mixing chamber.

7. The device according to claim 1, further comprising a dip tube disposed between the first inlet and the liquid reservoir.

8. The device according to claim 1 further comprising a check valve disposed between the first inlet and the liquid reservoir.

9. The device according to claim 1, the liquid reservoir comprising a liquid filled collapsible pouch.

10. The device according to claim 1 wherein the valve comprises a ball check valve.

11. A device for dispensing liquids in the form of foam, the device comprising a container and a foam engine operably connected to the container, the container comprising:

an interior, the interior adapted to concurrently comprise a liquid reservoir and a gas reservoir;

a finish adapted to receive the foam engine, the finish having an axis of orientation substantially aligned with a centerline of the finish;

the foam engine having an axis of foam discharge, the orientation of the axis of foam discharge being substantially different from the orientation of the axis of the container finish, the foam engine comprising: an engine body comprising a cylindrical barrel, a valve switchable between open and closed states disposed between the interior of the container and the exterior of the container, an engine insert disposed within the barrel; and a diffuser disposed within the engine insert:

the barrel comprising: a first inlet in fluid communication with the liquid reservoir, a second inlet in fluid communication with the gas reservoir, and a vent comprising the switchable valve;

a check valve disposed along the second inlet, the check valve configured to allow fluid flow from the reservoir into the mixing chamber and to prevent the flow of fluid from the mixing chamber into the reservoir;

the insert comprising a mixing chamber having a first mixing chamber inlet aligned with the first barrel inlet, a second mixing chamber inlet aligned with the second barrel inlet;

wherein the diffuser is disposed downstream along the axis of foam discharge from the mixing chamber.

12. The device according to claim 11 wherein the insert is movably disposed within the barrel and may be rotated between a first position and a second position; wherein at least one of the mixing chamber inlets is unaligned with the corresponding barrel inlet in the second position.

13. The device according to claim 12 wherein the insert may be rotated between the first and second positions.

14. The device according to claim 12 wherein the insert may be moved laterally along the axis of foam discharge between the first and second positions.

15. The device according to claim 11 wherein the foaming engine further comprises a mesh element disposed downstream from the diffuser along the axis of foam discharge.

16. The device according to claim 11 wherein the device comprises a hinged cap at an outlet of the foam engine.

17. The device according to claim 11 wherein the device comprises a container pressurizing element.

18. The device according to claim 11, further comprising a dip tube disposed between the first inlet and the liquid reservoir.

19. The device according to claim 11 further comprising a check valve disposed between the first inlet and the liquid reservoir.

20. The device according to claim 11, the liquid reservoir comprising a liquid filled collapsible pouch.

* * * * *